US007296607B2

(12) United States Patent
Krupke et al.

(10) Patent No.: US 7,296,607 B2
(45) Date of Patent: Nov. 20, 2007

(54) SIDE MOUNT COUNTERBALANCE SYSTEM FOR UPWARD ACTING DOOR

(75) Inventors: LeRoy G. Krupke, Carrollton, TX (US); Marius C. Suchici, Lewisville, TX (US)

(73) Assignee: Overhead Door Corporation, Lewisville, TX (US)

( * ) Notice: Subject to any disclaimer, the term of this patent is extended or adjusted under 35 U.S.C. 154(b) by 405 days.

(21) Appl. No.: 10/974,097

(22) Filed: Oct. 27, 2004

(65) Prior Publication Data

US 2006/0096720 A1 May 11, 2006

(51) Int. Cl.
*E05F 15/00* (2006.01)

(52) U.S. Cl. ..... 160/191; 160/193

(58) Field of Classification Search ..... 160/189, 160/190, 191, 192, 201, 193; 16/198, 401; 49/200; 185/44, 37, 39; 74/417
See application file for complete search history.

(56) References Cited

U.S. PATENT DOCUMENTS

| | | | | |
|---|---|---|---|---|
| 1,465,695 | A | 8/1923 | Stewart | |
| 1,827,433 | A | 10/1931 | Kendall | |
| 1,857,756 | A * | 5/1932 | Headley | 160/209 |
| 1,861,748 | A | 6/1932 | McCloud | |
| 1,938,978 | A | 12/1933 | Rush | |
| 2,033,893 | A | 3/1936 | White | |
| 2,093,019 | A | 9/1937 | Norberg | |
| 2,096,251 | A | 10/1937 | Knight et al. | |
| 2,171,194 | A * | 8/1939 | Smith | 16/104 |
| 2,420,301 | A | 5/1947 | Cusumano | |
| 2,488,496 | A | 11/1949 | Mattson | |
| 2,841,724 | A | 7/1958 | Brown | |
| 2,882,044 | A | 4/1959 | Ginte | |
| 3,147,001 | A | 9/1964 | Purdy | |
| 3,311,159 | A | 3/1967 | Stansberry | |
| 3,413,680 | A | 12/1968 | Rowe et al. | |
| 4,472,910 | A * | 9/1984 | Iha | 49/139 |
| 4,976,168 | A | 12/1990 | Lotznicker et al. | |
| 5,048,653 | A | 9/1991 | Fellows | |
| 5,222,327 | A | 6/1993 | Fellows et al. | |
| 5,698,073 | A | 12/1997 | Vincenzi | |
| 5,743,046 | A | 4/1998 | Siegler et al. | |
| 5,964,268 | A * | 10/1999 | Carper et al. | 160/191 |
| 6,957,683 | B2 * | 10/2005 | Toti | 160/170 |
| 6,959,751 | B2 * | 11/2005 | Savard et al. | 160/315 |
| 2002/0162634 | A1 * | 11/2002 | Dorma | 160/201 |

* cited by examiner

*Primary Examiner*—Blair M. Johnson
(74) *Attorney, Agent, or Firm*—Gardere Wynne Sewell LLP

(57) ABSTRACT

A counterbalance system for an upward acting door includes a cable drum support shaft and a torsion spring drive mechanism mounted adjacent one or both sides of the door and drivably connected to the drum support shaft. The spring drive mechanism includes a torsion coil spring mounted on a frame and connected to a vertically oriented shaft which, in turn, is connected to an output shaft by way of a bevel gear drive. A spring winder device is connected to one end of the spring and to the frame. Indicia on the spring is viewable through a window on the mechanism frame for indicating the number of revolutions imposed on the spring to set a predetermined counterbalance torque.

24 Claims, 6 Drawing Sheets

SIDE MOUNT COUNTERBALANCE SYSTEM FOR UPWARD ACTING DOOR

BACKGROUND OF THE INVENTION

In the art of upward acting doors, it is conventional practice to provide a counterbalance or door lifting assist system comprising an elongated shaft mounted generally above and adjacent to the door, the shaft including spaced apart cable drums for counterbalance cables which are connected to the opposite lower edges of the door. Counterbalance forces are typically provided by one or more torsion coil springs sleeved over the shaft between the cable drums and connected at one end to an anchor bracket and at an opposite end to the counterbalance shaft or directly to one of the cable drums. Conventional counterbalance systems also require manual winding of the torsion springs, a long-standing, nettlesome and somewhat hazardous operation. Spring replacement is also difficult and normally requires disassembly of the counterbalance system or at least major portions thereof.

Certain improvements in torsion spring type counterbalance systems for upward acting doors have been provided, such as disclosed and claimed in U.S. Pat. No. 6,134,835, assigned to the assignee of the present invention. However, additional improvements have been sought in counterbalance systems for upward acting doors and it is to these ends that the present invention has been developed.

SUMMARY OF THE INVENTION

The present invention provides an improved counterbalance system for upward acting doors, in particular.

In accordance with one aspect of the present invention, a counterbalance system for an upward acting door is provided which includes one or more torsion coil springs which are disposed in a spring drive mechanism which may be mounted adjacent to an upward acting door and connected directly to one end of a counterbalance cable drum shaft. Accordingly, the spring drive mechanism is a separate device which does not require installation on or around the cable drum shaft and may be easily serviced or replaced, including replacement of the torsion spring, without disassembly of or removal of the cable drum shaft.

In accordance with another aspect of the present invention, an improved counterbalance system for an upward acting door is provided wherein a counterbalance spring drive mechanism includes a torsion coil spring which may be easily replaced or the entire drive mechanism itself may be interchanged at a door installation. Spring drive mechanisms may be provided for various specific door weights or sizes and may be conveniently installed and connected to the door counterbalance or cable drum shaft with a mechanically uncomplicated coupling. The spring drive mechanism also includes a housing or frame adapted to be mounted to a wall or door jamb directly adjacent the door or attached to a door header bracket which supports the counterbalance cable drums and/or door guide tracks. A right angle drive gear arrangement provides for a compact mechanism which requires minimal space adjacent one or both ends of the cable drum counterbalance shaft.

In accordance with yet a further aspect of the invention, an improved upward acting door counterbalance system is provided which may be easily installed and counterbalance forces adjusted by a torsion spring adjustment mechanism mounted on a spring drive mechanism and which is easily accessible for adjusting spring torque. The amount of counterbalance force being provided may be monitored during the installation process by an improved indicator arrangement which indicates the number of turns of the torsion spring. Still further, the torsion spring is provided with gaps or clearances between the spring coils when the spring is in a relaxed state to avoid spring "growth" as spring torque is applied to match the counterbalance requirements of the door.

The advantages and superior features of the invention mentioned herein, together with other important aspects of the invention, will be further appreciated upon reading the detailed description which follows in conjunction with the drawings.

DETAILED DESCRIPTION OF PREFERRED EMBODIMENTS

Figure 1:
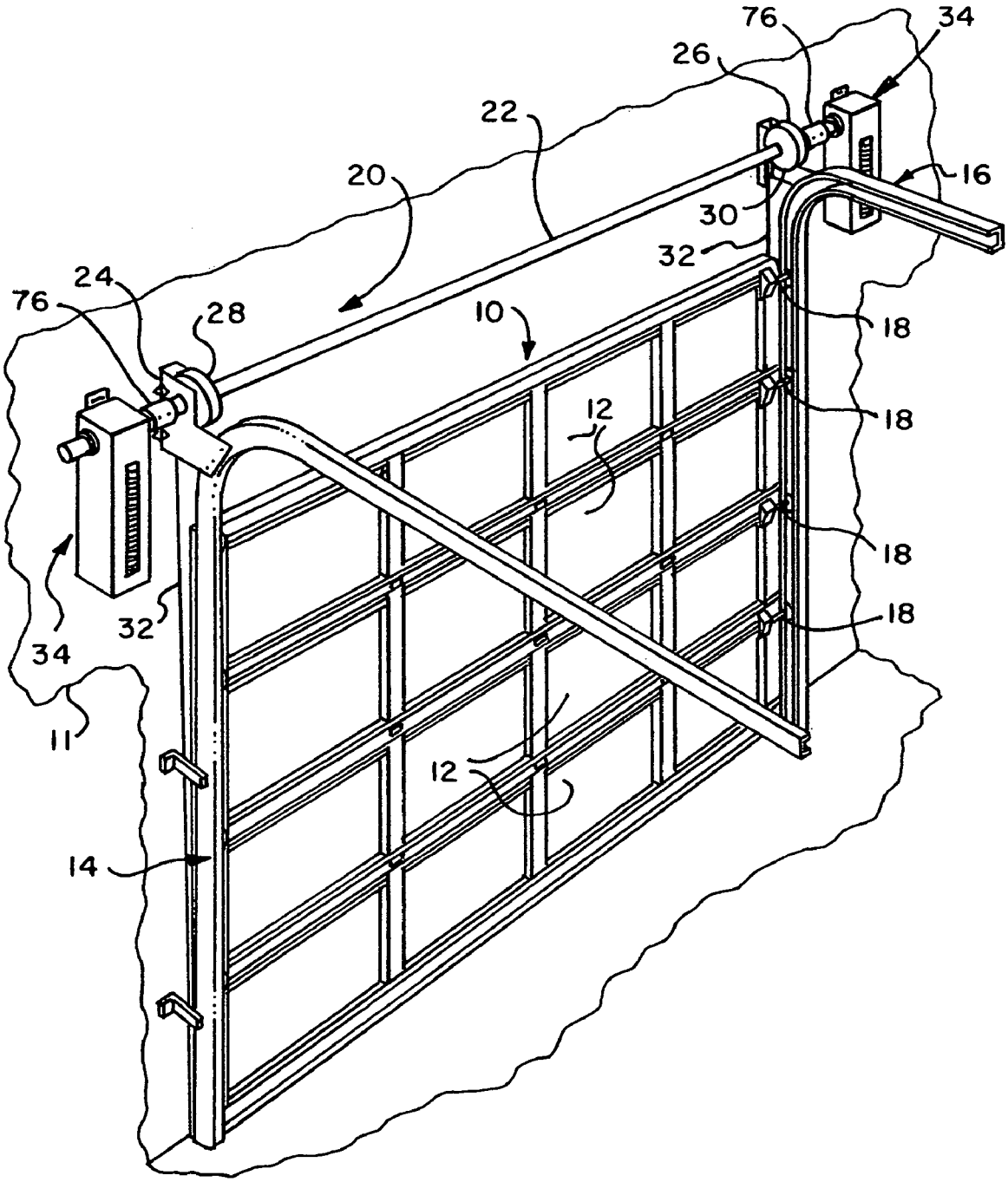
FIG. 1 is a perspective view of a multi-section upward acting door including the improved counterbalance system of the present invention.

In the description which follows, like parts are marked throughout the specification and drawings with the same reference numerals, respectively. The drawing figures may not be to scale and certain features may be shown in somewhat generalized or schematic form in the interest of clarity and conciseness.

Referring to FIG. 1, there is illustrated an upward acting door of generally conventional construction and generally designated by the numeral 10. The door 10 is illustrated as a multi-panel or multi-section type door including plural interconnected door sections 12 which are hingedly connected to each other and are disposed between opposed guide tracks 14 and 16. The door panels 12 are provided with opposed sets of guide rollers 18, shown only for the right side of the door viewing FIG. 1, for guiding the door for movement between a closed position shown and an open position, also in a generally conventional manner. A multi-section door is illustrated although a single panel door may also be operated by the counterbalance system of the present invention.

Referring further to FIG. 1, an improved counterbalance system of the invention is illustrated and generally designated by the numeral 20. The counterbalance system 20 is characterized by an elongated rotatable shaft 22 supported by and between opposed wall or so-called header brackets 24 and 26 which include suitable bearings, not shown, for supporting the shaft 22. Spaced apart cable drums 28 and 30 are mounted on the shaft 22 and are rotatable with the shaft. Cable drums 28 and 30 are, respectively, connected to depending counterbalance cables 32, which cables are connected at their lower ends to opposed lower edges of the bottommost door panel in a conventional manner. The header brackets 24 and 26 are also adapted to partially support the track assemblies 14 and 16, respectively.

As will be noted from FIG. 1, the rotatable counterbalance shaft 22 is devoid of any counterbalance springs sleeved thereover. However, counterbalance forces or torque may be imposed on the shaft 22 and the drums 28 and 30 to counterbalance the weight of the door 10 by the provision of one or more counterbalance spring drive mechanisms 34. Two counterbalance spring drive mechanisms 34 are shown in the illustration of FIG. 1 and are drivably connected to opposite ends of the shaft 22. Depending on the size and weight of the door to be counterbalanced, only a single spring drive mechanism 34 may be required.

Figure 2:
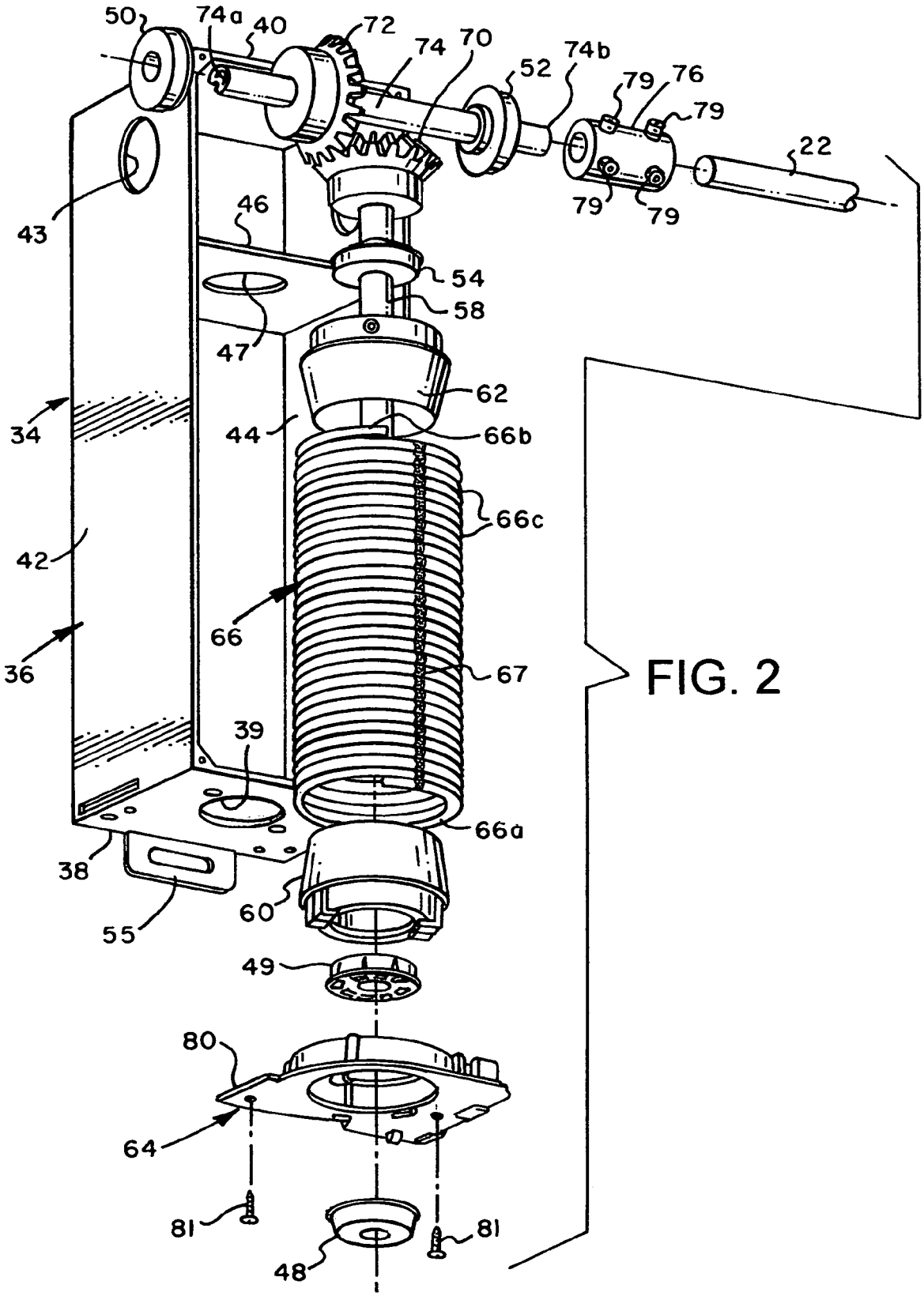
FIG. 2 is an exploded perspective view of the counterbalance spring drive mechanism of the present invention.
Figure 3:
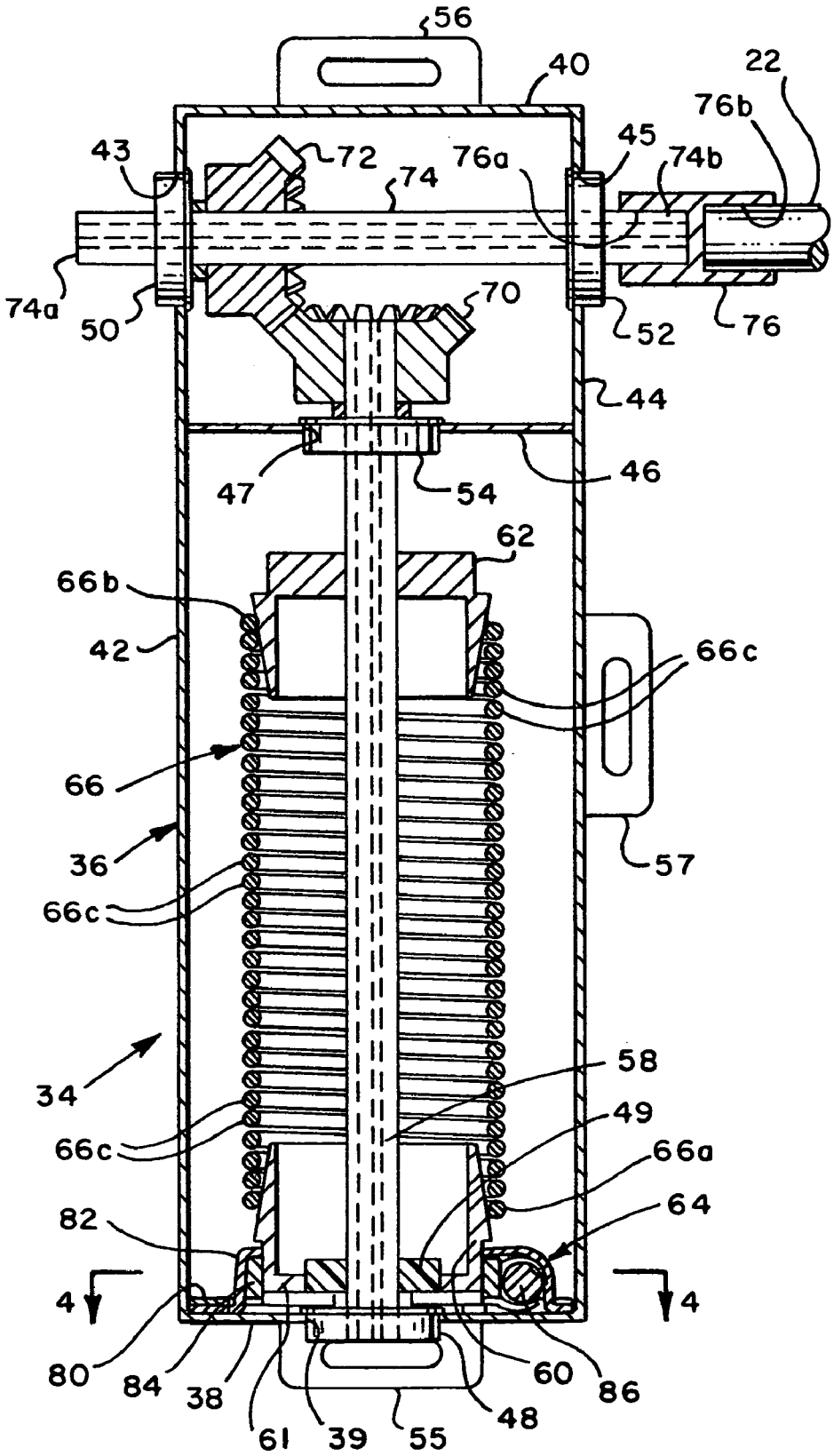
FIG. 3 is a longitudinal central section view of the mechanism shown in FIG. 2 in an assembled condition.

Referring now to FIGS. 2 and 3, one of the torsion spring drive mechanisms 34 is illustrated in exploded perspective view (FIG. 2) and in a central section view with the parts assembled (FIG. 3). The drive mechanism 34 is characterized by a generally rectangular boxlike frame or housing 36 having a bottom wall 38, a top wall 40, and opposed side walls 42 and 44. A transverse intermediate wall 46 extends between side walls 42 and 44 as illustrated. Respective bearing receiving bores 39, 43, 45 and 47 are formed in frame walls 38, 42, 44 and 46 for receiving respective shaft support bearings 48, 50, 52 and 54. As shown in FIG. 3, spaced apart mounting flanges 55, 56 and 57 are formed integral with or firmly attached to walls 38, 40 and 44 for mounting the mechanism 34 against a wall 11, for example, see FIG. 1, at which door 10 is disposed.

Referring further to FIGS. 2 and 3, the spring drive mechanism 34 is also characterized by an elongated drive shaft 58 supported for rotation by bearings 48 and 54 on frame 36. Spaced apart torsion spring support plugs or cones 60 and 62 are sleeved over the shaft 58, as shown in FIG. 3. Spring support plug 62 is suitably connected to shaft 58 for rotation therewith while spring plug or cone 60 is mounted on a bearing 49 which journals shaft 58 and allows rotation of shaft 58 with respect to plug 60. Plug or cone 60 is operably connected to a spring winder device 64 which will be described in further detail herein. Bearings 48, 50, 52 and 54 may all be of a sealed rolling element type, commercially available, while bearing 49 may be of a molded self-lubricating plastic, such as nylon, for example. Bearings 48, 50, 52 and 54 are each, preferably snap or press fitted into the bearing bores on frame 36 associated with these bearings, respectively.

Referring still further to FIGS. 2 and 3, an elongated torsion coil spring 66 is sleeved over shaft 58 and is secured at its opposite ends to the spring plugs 60 and 62 in a conventional manner wherein the spring does not rotate relative to the spring plugs at respective ends 66*a* and 66*b*. As shown in FIG. 2, when spring 66 is in a relaxed condition, the coils 66*c* are partially separated and are provided with suitable indicia comprising a contrasting set of marks which are aligned to provide a substantially continuous straight indicia line 67 which extends axially with respect to the spring 66 and the shaft 58, and the purpose of which will be explained further herein.

Referring still further to FIGS. 2 and 3, shaft 58 supports a bevel gear 70 on one end thereof and is drivably connected thereto. Bevel gear 70 is meshed with a bevel gear 72 which is mounted on and drivably connected to an output shaft 74 for the drive mechanism 34. Output shaft 74 is journaled in bearings 50 and 52 and includes opposed ends 74*a* and 74*b* which extend beyond the frame sidewalls 42 and 44, respectively, and beyond the bearings in which the shaft 74 is supported. Shaft 74 extends at substantially a right angle to shaft 58 and this arrangement, including bevel gears 70 and 72, provides reduced space requirements for mechanism 34. As shown by way of example, shaft end 74*b* is connected to a suitable coupling 76 comprising a generally tubular member with opposed, coaxial shaft receiving bores 76*a* and 76*b* formed therein. Coupling 76 is adapted to be connected to one end of shaft 22, as shown in FIGS. 2 and 3, and coupling 76 is operable to be secured to both shafts 74 and 22 by respective spaced apart setscrews 79, see FIG. 2. Other means of securing the coupling 76 to the shafts 74 and 22 may be provided. Moreover, coupling 76 may be connected to either end of shaft 74, depending on the location of drive mechanism 34 with respect to a counterbalance shaft to which the drive mechanism is to be connected.

Figure 4:
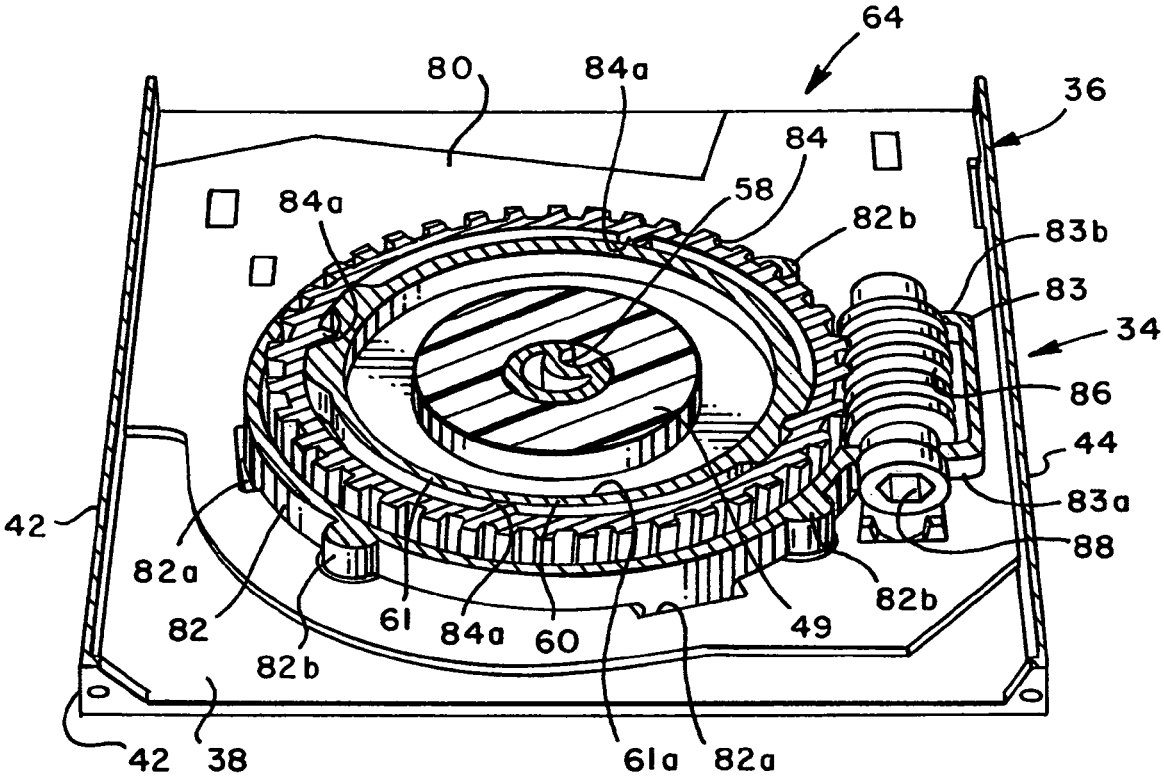
FIG. 4 is a section view in somewhat perspective orientation and taken generally from the line 4-4 of FIG. 3.

Referring now to FIGS. 3 and 4, further details of the spring winder mechanism 64 will be explained. The spring winder mechanism 64 is characterized by a frame plate member 80 which may be secured to the bottom wall 38 by suitable fasteners 81, see FIG. 2, between the sidewalls 42 and 44. The frame plate 80 supports a generally cylindrical housing 82, which journals a ring gear 84 and a worm gear 86. Worm gear 86 is meshed with ring gear 84 in a conventional manner and worm gear 86 includes a polygonal shaped drive socket 88, FIG. 4, for drivably rotating worm gear 86 to effect rotation of ring gear 84. A suitable power tool with a hex shaped rotatable output drive shaft, not shown, may be connected to worm gear 86 at socket 88 to effect driving action in opposite directions of rotation. As shown in FIG. 4, housing 82 includes a radially projecting part 83 provided with opposed end walls 83*a* and 83*b* with suitable recesses formed therein for journaling the worm gear 86 between housing 82 and plate 80 for rotation with respect to housing 82. Housing 82 is suitably anchored to the frame plate 80 by circumferentially spaced flanges and projections 82*a* and 82*b*, as also shown in FIG. 4. Ring gear 84 includes radially inwardly projecting key portions 84*a*, circumferentially spaced, as shown in FIG. 4, and fitted in cooperating grooves formed in a hub part 61 of plug 60. Hub part 61 includes a cylindrical bore 61*a* for receiving bearing 49. Accordingly, ring gear 84 is drivably connected to plug member 60 for rotating same in response to rotation of the worm gear 86. In this way the torsion spring 66 may be wound or unwound as required for adjusting the counterbalance torque imposed on shaft 22 by way of shaft 58, bevel gears 70 and 72, shaft 74 and coupling 76.

Figure 5:
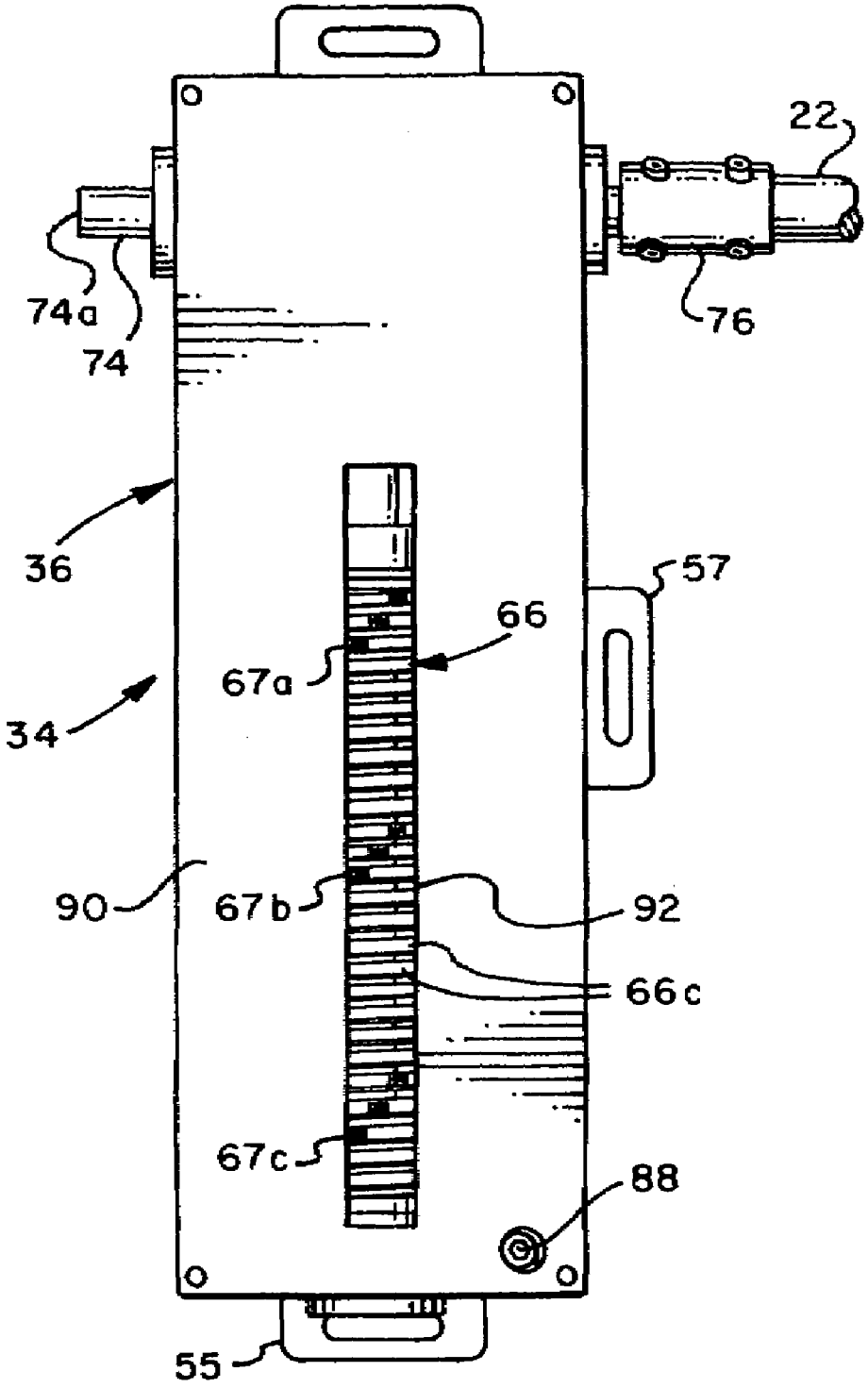
FIG. 5 is a front elevation of the spring drive mechanism showing the arrangement for visually inspecting the spring and determining the number of spring turns or windings imposed on the counterbalance spring.

Referring briefly to FIG. 5, the spring drive mechanism 34 is shown in a front side elevation view with a removable platelike cover member 90 suitably secured to frame 36 to at least partially enclose the drive mechanism including the spring 66. However, as shown in FIG. 5, an elongated slot 92 is formed in cover member 90 comprising a window centrally located between the sidewalls 42 and 44 of the frame 36 for viewing the coils 66*c* of spring 66. As shown in FIG. 5, with spring 66 wound by the winder mechanism 64 by way of drive socket 88 of worm gear 86, the indicia line 67 formed on the respective coils assumes the configuration of spaced apart bands of indicia 67*a*, 67*b* and 67*c* as illustrated in FIG. 5. The number of bands of indicia viewable through the slot 92 indicates the number of turns or revolutions that have been imposed on the spring 66 by the winder mechanism 64, which number of turns may be correlated with the amount of counterbalance torque to be imposed on a particular door.

The construction and operation of the counterbalance system 20, including the spring drive mechanisms 34, is believed to be understandable to those of skill in the art based on the foregoing description. The counterbalance spring drive mechanism 34 may be preassembled at its source of manufacture. Accordingly, the particular spring characteristics of the torsion spring 66 may be selected in accordance with the size and weight of the door to be counterbalanced by the system 20. The counterbalance spring 66, as mentioned, is preferably preformed with gaps or clearances between the coils 66*c* so that the spring will not grow in length as torque is applied to the spring. The coupling 76 may be formed to be somewhat tamper resistant if desired. Adjustment of torque imposed on the shaft 22 by the spring drive mechanism 34 may be easily carried out by winding or unwinding spring 66 by way of the winder mechanism 64. The direction of rotation of shaft 74 with respect to the shaft 22 is such that the spring drive mechanism 34 may be mounted for connection to either end of shaft 22 without affecting direction of rotation of shaft 22. In this way dual spring drive mechanisms 34 may be connected to a single shaft 22, as shown in FIG. 1, or a single drive mechanism 34 may be used if the power requirements are such as to require only one drive mechanism.

Accordingly, a preassembled spring drive mechanism or mechanisms 34 may be mounted on wall 11 and coupled to shaft 22 at either end or both ends thereof. The spring or springs 66 may then be easily wound to the requisite torque by applying a suitable power tool to the drive socket 88 of worm 86 which rotates ring gear 84, plug 60 and end 66*a* of spring 66. If any part of mechanism 34 should fail, including the spring 66, the mechanism may be easily replaced without disconnecting the counterbalance cables from the door and removing shaft 22, as required by conventional counterbalance mechanisms with torsion springs sleeved over the shaft which drives the counterbalance cable drums. Moreover, adjustment of the torque imposed by the spring 66 may be easily carried out when required. Alternatively, each of the spring drive mechanisms 34 may be connected directly to respective ones of cable drums 26 and 28 and thereby eliminating shaft 22 extending between the drums. However, balancing of torques imposed on drums 28 and 30 and movement of door 10 is easier to accomplish with a common drive shaft, such as the shaft 22.

Figure 6:
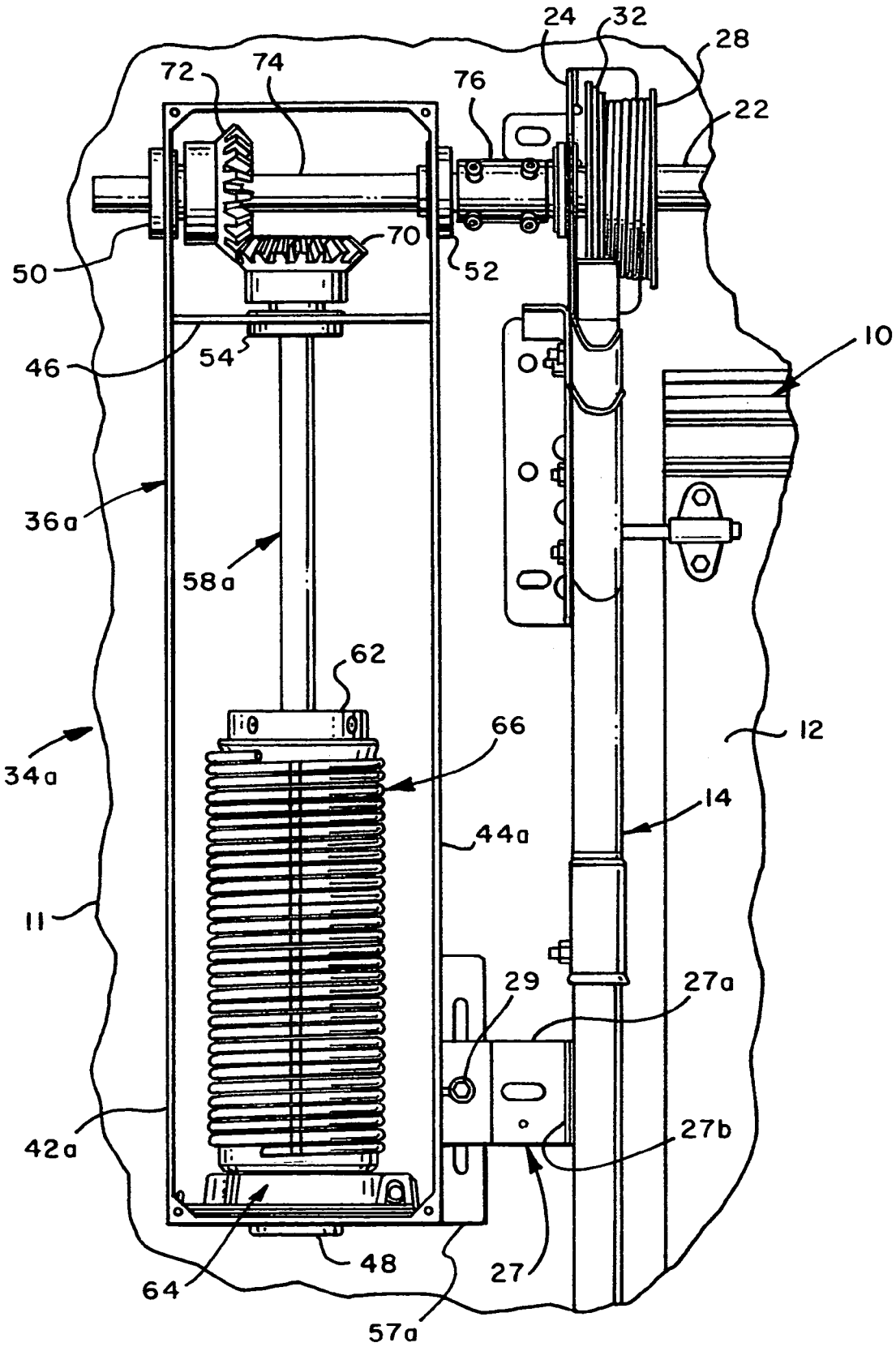
FIG. 6 is a front elevation view of an alternate embodiment of the present invention.

Referring briefly to FIG. 6, an alternate embodiment of a spring drive mechanism is illustrated and generally designated by the numeral 34*a*. The spring drive mechanism 34*a* is substantially like the spring drive mechanism 34 except the mechanism 34*a* includes a frame or housing 36*a* having an overall length greater than the housing 36 and a drive shaft 58*a* also of a length greater than the drive shaft 58. The spring drive mechanism 34*a* is suited for utilizing springs, such as the spring 66, which may be of various lengths as required by the counterbalance requirements of a door connected to the mechanism 34*a*. Accordingly, the housing 36*a* and drive shaft 58*a* are able to accommodate a wide variety of torsion coil springs operably connected to the plug 62 and the winder mechanism 64 in place of the spring 66 illustrated.

Another difference between the drive mechanism 34*a* and the drive mechanism 34 is provided wherein the housing 36*a* includes an elongated flange 57*a* on one side thereof adapted to be connected to a somewhat L-shaped bracket 27 which includes a first flange 27*a* connected to flange 57*a* by a suitable fastener 29 and a second flange 27*b* connected to the guide track 14 by suitable fasteners, not shown. Spring drive mechanism 34*a* is thus supported with respect to the counterbalance shaft 22 by the coupling 76 and the bracket 27. Frame 36*a* may or may not be disposed contiguous with wall 11 in the same manner as housing or frame 36. However, the spring drive mechanism 34*a* may not be required to be secured directly to the wall 11 but the wall may react any forces on the drive mechanism which are not adequately counteracted by the bracket 27 and the connection of the drive mechanism to the shaft 22 via coupling 76.

Those skilled in the art will recognize that the drive mechanism 34*a* may also be modified to be connected by a suitable bracket, not shown, to the so-called header bracket 24, if desired. In drawing FIG. 6, a cover similar to cover 90 has been removed to allow viewing the internal components of the drive mechanism 34*a*. The housing or frame 36*a* is essentially like the housing or frame 36 except for the length of sidewalls 42*a* and 44*a* and the elimination of unneeded mounting flanges.

Conventional engineering materials and practices may be used to fabricate the counterbalance system 20 including the spring drive mechanisms 34 and 34*a*. Although preferred embodiments of the invention have been described in detail herein, those skilled in the art will recognize that various substitutions and modifications may be made without departing from the scope and spirit of the appended claims.

What is claimed is:

1. In a counterbalance system for an upward acting door, a spring drive mechanism comprising:

a frame;

a first shaft mounted for rotation on said frame and adapted to be connected to a coupling for coaxially connecting said first shaft to a counterbalance shaft;

a second shaft mounted on said frame extending at substantially a right angle to said first shaft and drivingly connected to said first shaft by cooperating gears mounted on said first shaft and said second shaft, respectively; and a torsion coil spring disposed over and operably connected to said second shaft for imposing a counterbalance torque on said counterbalance shaft.

2. The invention set forth in claim 1 including:

means for mounting said frame on a structure adjacent to said door.

3. The invention set forth in claim 1 including:

a spring winder device operably connected to one end of said spring and to said frame for imparting torsional windup to said spring to adjust a counterbalance torque exerted by said mechanism on said counterbalance shaft.

4. The invention set forth in claim 3 wherein:

said spring winder device comprises a ring gear drivably connected to a spring plug connected to one end of said spring and a worm gear meshed with said ring gear and including a drive member for engagement by a tool for rotating said worm gear and said ring gear to impart torsional windings to said spring.

5. The invention set forth in claim 1 including:

indicia formed on said spring and means forming a window on said frame for viewing said indicia to determine the number of revolutions of windup of said spring.

6. In a counterbalance system for an upward acting door, a torsion spring drive mechanism adapted for driving connection to an elongated counterbalance shaft operably connected to said door for counterbalancing at least part of the weight of said door, said torsion spring drive mechanism comprising:

a frame;

a first shaft mounted for rotation on said frame;

a coupling connected to said first shaft and adapted for connection to said counterbalance shaft;

a second shaft mounted on said frame and extending at a substantially right angle to said first shaft;

cooperating bevel gears mounted on said first shaft and said second shaft for drivably interconnecting said first shaft and said second shaft;

a torsion coil spring disposed over said second shaft and connected at its opposite ends to opposed spring plugs, one of said spring plugs being drivingly connected to said second shaft, the other of said spring plugs being rotatable with respect to said second shaft; and a spring winder device operably connected to said second spring plug, said spring winder device comprising a worm gear drive for rotating said second plug to impart torsional windings to said spring to adjust a torque imposed on said counterbalance shaft through said spring drive mechanism.

7. The invention set forth in claim 6 wherein:

said frame includes means for mounting said spring drive mechanism adjacent to one end of said counterbalance shaft.

8. The invention set forth in claim 6 including:

indicia on said spring for indicating the number of revolutions imposed on said spring from a relaxed condition of said spring.

9. The invention set forth in claim 8 wherein:

said indicia comprises markings on respective coils of said spring forming an axially extending line in a relaxed state of said spring.

10. The invention set forth in claim 9 including:

a member disposed on said frame and forming a window for viewing said indicia on said spring to determine the number of revolutions imposed on said spring from said relaxed state.

11. In an upward acting door, a counterbalance system for counterbalancing at least part of the weight of said door, said counterbalance system including an elongated counterbalance shaft supported generally above and adjacent to said door, spaced apart cable drums mounted on said shaft and connected to depending cables, respectively, said cables being connected to said door; and a torsion spring drive mechanism mounted adjacent to one end of said counterbalance shaft and drivably connected thereto, said spring drive mechanism including a frame, a first shaft mounted for rotation on said frame, a coupling for connecting said first shaft to said counterbalance shaft, a second shaft mounted on said frame, cooperating gears connected to said first shaft and said second shaft for drivably connecting said second shaft to said first shaft and a torsion coil spring supported on said frame and drivably connected to said second shaft for imparting a torque on said first shaft for transmission to said counterbalance shaft.

12. The counterbalance system set forth in claim 11 wherein:

said first shaft and said second shaft extend at substantially right angles to each other, said first shaft being substantially coaxial with said counterbalance shaft.

13. The counterbalance system set forth in claim 12 wherein:

said torsion coil spring is sleeved over said second shaft.

14. The counterbalance system set forth in claim 13 including:

a first spring plug mounted on said second shaft and drivably connected thereto and a second spring plug disposed spaced from said first spring plug and supported on said frame.

15. The counterbalance system set forth in claim 14 wherein:

said second spring plug is connected to said frame by way of a spring winding device for rotating said second spring plug to impart a torsional wind-up to said torsion coil spring.

16. The counterbalance system set forth in claim 15 wherein:

said winding device comprises a ring gear drivably connected to said second spring plug and a worm gear meshed with said ring gear and operable to rotate said ring gear to impart a torsional wind-up to said torsion coil spring.

17. In an upward acting door, a counterbalance system for counterbalancing at least part of the weight of said door, said counterbalance system including an elongated counterbalance shaft supported generally above and adjacent to said door, spaced apart cable drums mounted on said shaft and connected to depending cables, respectively, said cables being connected to said door; and a torsion spring drive mechanism mounted adjacent to one end of said counterbalance shaft and drivably connected thereto, said spring drive mechanism including a frame, a first shaft mounted for rotation on said frame, a coupling for connecting said first shaft to said counterbalance shaft, said frame comprising a generally rectangular boxlike member including a bottom wall, a top wall and opposed side walls and bearing means mounted on at least respective ones of said side walls for supporting said first shaft, a torsion coil spring supported on said frame and operable to impart a torque on said first shaft for transmission to said counterbalance shaft, and a cover removably connected to said frame having an elongated slot formed therein for viewing indicia on said spring indicating the amount of torsional wind-up of said spring.

18. The counterbalance system set forth in claim 17 wherein:

said indicia comprises markings formed on respective coils of said spring and co-linear with each other in a substantially relaxed condition of said spring.

19. In an upward acting door, a counterbalance system for counterbalancing at least part of the weight of said door, said counterbalance system including an elongated counterbalance shaft supported generally above and adjacent to said door, spaced apart cable drums mounted on said shaft and connected to depending cables, respectively, said cables being connected to said door; and a torsion spring drive mechanism mounted adjacent to one end of said counterbalance shaft and drivably connected thereto, said spring drive mechanism including a frame, a torsion coil spring supported on said frame, means operably connected to said spring and said frame for securing one end of said spring stationary with respect to said frame, and a first shaft supported for rotation on said frame and operably connected to said counterbalance shaft and to said spring for transferring torque therebetween and a second shaft mounted on said frame, cooperating gears connected to said first shaft and said second shaft for drivably connecting said second shaft to said first shaft and said spring is drivably connected to said second shaft.

20. The counterbalance system set forth in claim 19 wherein:

said first shaft and said second shaft extend at substantially right angles to each other, said first shaft being substantially coaxial with said counterbalance shaft.

21. The counterbalance system set forth in claim 19 including:

a first spring plug mounted on said second shaft and drivably connected to said spring and said second shaft, and said means operably connected to said spring and said frame comprises a second spring plug connected to said frame by way of a spring winding device for rotating said second spring plug to impart a torsional wind-up to said spring.

22. The counterbalance system set forth in claim 21 wherein:

said winder device comprises a ring gear drivably connected to said second plug and a worm gear meshed with said ring gear and operable to rotate said ring gear to impart a torsional wind-up to said spring.

23. The counterbalance system set forth in claim 19 including:

a cover connected to said frame and an elongated slot formed in said cover for viewing indicia on said spring indicating the amount of torsional wind-up of said spring.

24. In an upward acting door, a counterbalance system for counterbalancing at least part of the weight of said door, said counterbalance system including an elongated counterbalance shaft supported generally above and adjacent to said door, spaced apart cable drums mounted on said shaft and connected to depending cables, respectively, said cables being connected to said door; and a torsion spring drive mechanism mounted adjacent to one end of said counterbalance shaft and drivably connected thereto, said spring drive mechanism including a frame,said frame comprising a generally rectangular boxlike member including a bottom wall, a top wall and opposed side walls and bearing means mounted on at least respective ones of said side walls for supporting a first shaft, a torsion coil spring supported on said frame, means operably connected to said spring and said frame for securing one end of said spring stationary with respect to said frame, said first shaft supported for rotation on said frame and operably connected to said counterbalance shaft and to said spring for transferring torque therebetween; and a cover removably connected to said frame and an elongated slot formed in said cover for viewing indicia on said spring indicating the amount of torsional wind-up of said spring.

* * * * *